US007159630B1

(12) United States Patent
Klatte-Rolfe

(10) Patent No.: US 7,159,630 B1
(45) Date of Patent: Jan. 9, 2007

(54) POCKETBOOK ASSEMBLY

(76) Inventor: Jacqueline E. Klatte-Rolfe, 7704 Woodland Dr., Black Hawk, SD (US) 57718

( * ) Notice: Subject to any disclaimer, the term of this patent is extended or adjusted under 35 U.S.C. 154(b) by 436 days.

(21) Appl. No.: 10/733,888

(22) Filed: Dec. 12, 2003

(51) Int. Cl.
*A45C 1/06* (2006.01)
*A45C 11/18* (2006.01)

(52) U.S. Cl. ..... 150/145; 150/131; 150/132

(58) Field of Classification Search ..... 150/131, 150/132, 135, 145; 206/37, 39; 40/1.5, 40/1.6

See application file for complete search history.

(56) References Cited

U.S. PATENT DOCUMENTS

| | | | | | |
|---|---|---|---|---|---|
| 1,928,337 | A * | 9/1933 | McClanahan | 229/72 |
| 2,477,840 | A * | 8/1949 | Vasilas | 150/136 |
| 2,732,875 | A * | 1/1956 | Martin | 150/147 |
| 2,878,850 | A * | 3/1959 | Quint | 206/37 |
| 3,759,305 | A * | 9/1973 | McIntyre | 150/149 |
| 4,492,390 | A | 1/1985 | Jacobs et al. | |
| 4,566,721 | A * | 1/1986 | Friedman et al. | 281/31 |
| 4,716,948 | A * | 1/1988 | Brissette | 150/132 |
| 4,890,728 | A | 1/1990 | Grimsley | |
| 5,059,052 | A | 10/1991 | Casper | |
| 5,114,009 | A * | 5/1992 | Johnston | 206/425 |
| 5,388,739 | A | 2/1995 | Gargan | |
| 5,775,398 | A * | 7/1998 | Siegel | 150/139 |
| D418,681 | S | 1/2000 | Livingston | |
| 6,086,106 | A * | 7/2000 | Joe et al. | 281/31 |
| 6,179,102 | B1 | 1/2001 | Weber et al. | |
| 6,367,842 | B1 * | 4/2002 | Wien et al. | 281/37 |

* cited by examiner

*Primary Examiner*—Sue A. Weaver

(57) ABSTRACT

A pocketbook assembly includes a pocketbook having a rectangular shape with a first compartment and a second compartment divided along a fold line extending between a top edge and a bottom edge. The pocketbook has a first side edge abutting the first compartment and a second side edge abutting the second compartment. Each of the first and second compartments has a first side and a second side. The first side of the first compartment has an elongated first slot therein. Each of the first and second sides of the first compartment has a viewing window therein for viewing an interior of the first compartment. The second side of the second compartment has an elongated second slot therein. The second slot extends between the second side edge and the fold line to form an opening into the second compartment.

8 Claims, 2 Drawing Sheets

POCKETBOOK ASSEMBLY

BACKGROUND OF THE INVENTION

1. Field of the Invention

The present invention relates to organizing devices and more particularly pertains to a new organizing device for organizing travel papers.

2. Description of the Prior Art

The use of organizing devices is ubiquitous in the prior art. U.S. Pat. No. 5,059,052 describes a travel planner having a plurality of sheets therein for tracking information such as dates and expenses. Another type of organizing device is U.S. Pat. No. 4,890,728 that includes a plurality of panels for holding a plurality of documents. Another such device having multiple storage panels is U.S. Pat. No. 4,492,390.

While these devices fulfill their respective, particular objectives and requirements, the need remains for a device that is more simplistic in nature for only holding required travel documents and holds an itinerary in such a manner that it may be read without opening the device.

SUMMARY OF THE INVENTION

The present invention meets the needs presented above by utilizing a pocketbook having strategically placed windows therein for viewing often-accessed information without the need for opening the pocketbook.

To this end, the present invention generally comprises a flexible pocketbook having a rectangular shape. The pocketbook includes a first compartment and a second compartment divided along a fold line extending between a top edge and a bottom edge of the pocketbook. The pocketbook has a first side edge abutting the first compartment and a second side edge abutting the second compartment. Each of the first and second compartments has a first side and a second side. The first side of the first compartment has an elongated first slot therein. The first slot is positioned adjacent to the first side edge and extends into the first compartment. Each of the first and second sides of the first compartment has a viewing window therein for viewing an interior of the first compartment. The second side of the second compartment has an elongated second slot therein. The second slot extends between the second side edge and the fold line to form an opening into the second compartment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
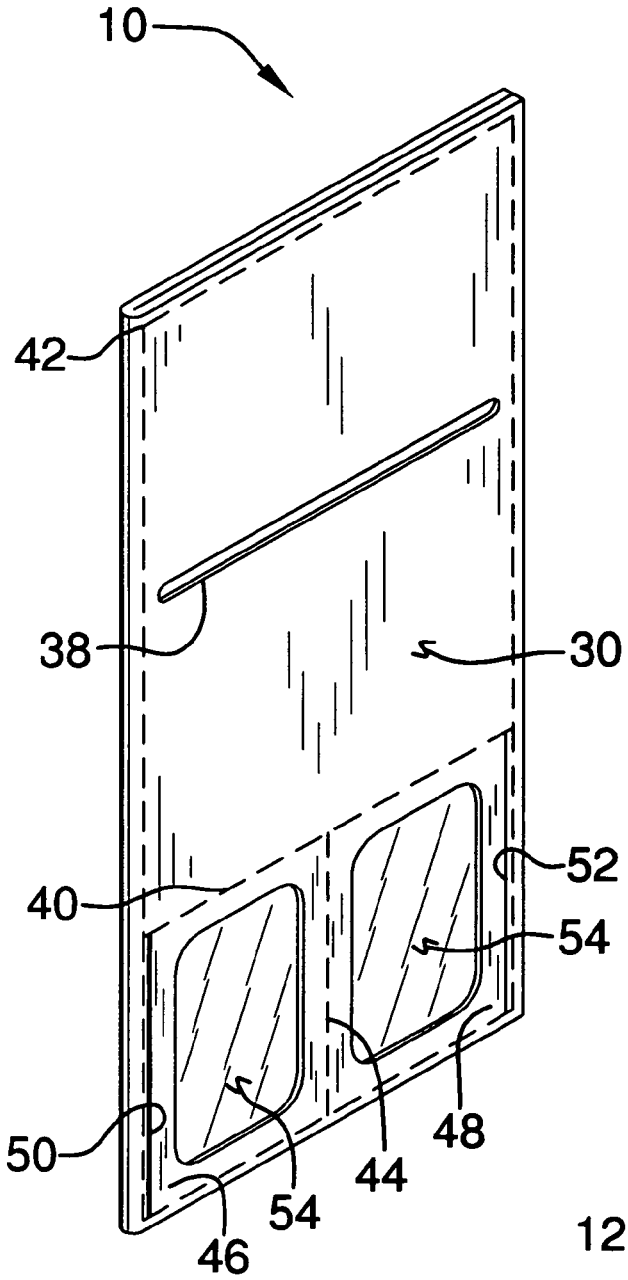
FIG. 1 is a schematic perspective front view of a pocketbook assembly according to the present invention.
Figure 2:
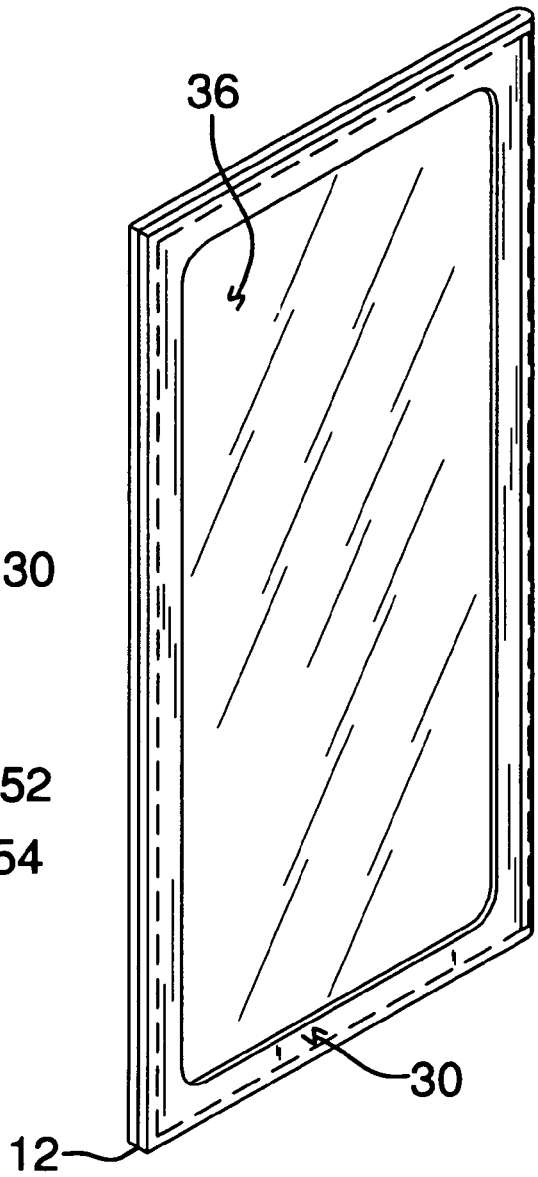
FIG. 2 is a schematic perspective back view of the present invention.
Figure 3:
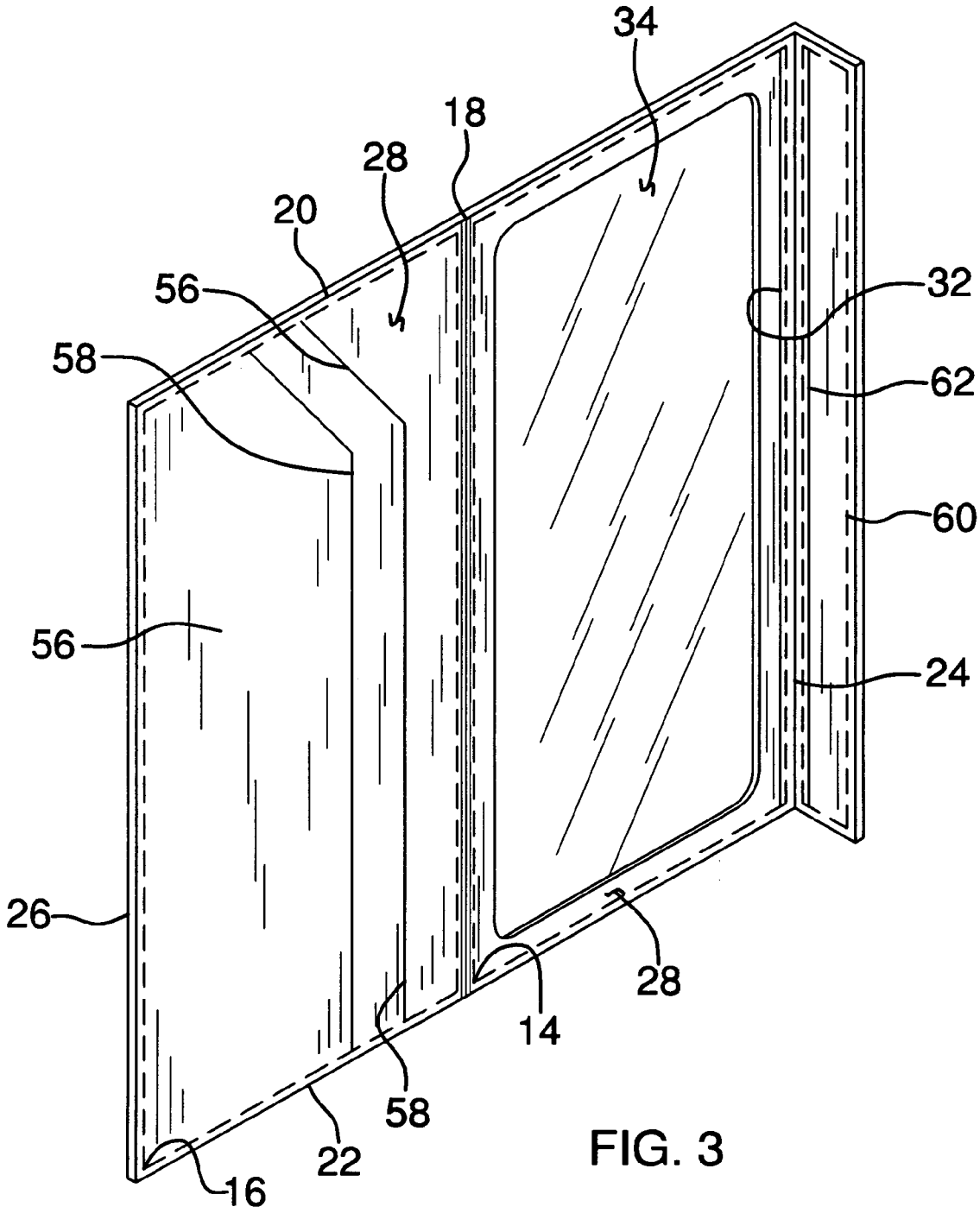
FIG. 3 is a schematic perspective view of the present invention in an open configuration.

With reference now to the drawings, and in particular to FIGS. 1 through 3 thereof, a new organizing device embodying the principles and concepts of the present invention and generally designated by the reference numeral 10 will be described.

As best illustrated in FIGS. 1 through 3, the assembly 10 generally comprises a flexible pocketbook 12 that has a rectangular shape. The pocketbook 12 is preferably constructed of conventional materials such as leather or flexible plastic. The pocketbook 12 includes a first compartment 14 and a second compartment 16 divided along a fold line 18 extending between a top edge 20 and a bottom edge 22 of the pocketbook 12. Preferably, stitching is extended along the fold line 18 for separating the first 14 and second 16 compartments. The pocketbook 12 has a first side edge 24 abutting the first compartment 14 and a second side edge 26 abutting the second compartment 16. Ideally, the bottom edge 22 has a length generally between 6 inches and 9 inches and the first side edge 24 has a height generally between 7 inches and 10 inches. Each of the first 14 and second 16 compartments has a first side 28 and a second side 30. The first side 28 of the first compartment 14 has an elongated first slot 32 therein. The first slot 32 is positioned adjacent to the first side edge 24 and extends into the first compartment 14. The first slot 32 extends along a length of the first side edge 24.

Each of the first 28 and second 30 sides of the first compartment 14 has a viewing window 34, 36 for viewing an interior of the first compartment 14. The viewing windows 34, 36 are preferably comprised of a flexible plastic material. The viewing windows 34, 36 preferably extend across a majority of the first compartment 14 so that a user of the pocketbook 12 may substantially view the entire first compartment 12.

The second side 30 of the second compartment 16 has an elongated second slot 38 therein. The second slot 38 extends between the second side edge 26 and the fold line 18 and forms an opening into the second compartment 16. The second slot 38 is positioned nearer the top edge 20 and than the bottom edge 22.

A dividing wall 40 extends between the second side edge 26 and the fold line 18 such that a first portion 42 and a second portion of the second compartment 16 is defined. The second portion is positioned adjacent to the bottom edge 22 so that the second slot 38 extends into the first portion 42. The dividing wall 40 is positioned between the bottom edge 22 and the second slot 38. Stitching preferably forms the dividing wall 40.

A section wall 44, again formed by stitching, extends between the dividing wall 40 and the bottom edge 22 to section the second portion into a first section 46 and a second section 48. The second side 30 of the second compartment 16 has a third slot 50 therein extending into the first section 46 and a fourth slot 52 extending into the second section 48. The second side 30 of the second compartment 16 has a pair of windows therein 54. Each of the windows 54 in the second compartment 16 is positioned for viewing into one of the sections 46, 48 and each is preferably constructed of a flexible plastic material.

Preferably, each of a plurality of pockets 56 is attached to the first side 28 of the second compartment 16. The pockets 56 are preferably flexible panels attached to the pocketbook 12 and have free edges 58 whereby items may be positioned between the free edges 58 and the first side 28.

In an embodiment of the assembly shown in FIG. 3, a flap 60 is pivotally attached to and extends along a length of the first side edge 24 for reasons which will be made clear below. The flap 60 may also include a fifth slot 62 for receiving items.

In use, the assembly 10 is primarily used for organizing information, paperwork, and identification for a person traveling. The first compartment is not divided and thus defined the largest pocket. The first compartment 14 has a pair of viewing windows 34, 36 for viewing an item from both sides once it is extended through the first slot 32 and into the first compartment 14. The size allows it to hold an itinerary for consulting information such as flight, hotel and rental car information. Boarding passes may be extended into the second slot 38 and identification cards and mileage cards may be placed in the third 50 and fourth 52 slots for viewing such through the windows 54. The pockets 56 allow for holding additional boarding passes. It should be understood that items such as passports may also be placed and held in the first 32 or second slots 38 or within the pockets 56. Baggage claim tickets typically have pressure sensitive adhesive thereon for attaching the claim tickets to boarding passes. However, the claim tickets may be attached to the panel 62 or positioned within the fifth slot 62 for easy access. The pocketbook 12 is folded along the fold line 18 for reducing its size so that it may be tucked into a pocket or bag.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An itinerary and identification holding device comprising:

a flexible pocketbook having a rectangular shape and being constructed of a non-transparent material, said pocketbook including a first compartment and a second compartment divided along a fold line extending between a top edge and a bottom edge of said pocketbook, said pocketbook having a first side edge abutting said first compartment and a second side edge abutting said second compartment, said bottom edge having a length generally between 6 inches and 9 inches, said first side edge having a height generally between 7 inches and 10 inches, each of said first and second compartments having a first side and a second side, said first side of said first compartment having an elongated first slot therein, said first slot being positioned adjacent to said first side edge and extending into said first compartment, each of said first and second sides of said first compartment having a viewing window therein for viewing an interior of said first compartment and viewing through said first compartment, said viewing windows in said first compartment having approximately a same size as each other, said second side of said second compartment having an elongated second slot therein, said second slot extending between said second side edge and said fold line and forming an opening into said second compartment, said second slot being positioned nearer said top edge and than said bottom edge;

a dividing wall extending between said second side edge and said fold line such that a first portion and a second portion of said second compartment is defined, said second portion being positioned adjacent to said bottom edge, said dividing wall being positioned between said bottom edge and said second slot, a section wall extending between said dividing wall and said bottom edge and sectioning said second portion into a first section and a second section, said second side of said second compartment having a third slot therein extending into said first section, said second side of said second compartment having a fourth slot therein extending into said second section, said second side of said second compartment having a pair of windows therein, each of said windows in said second compartment being positioned for viewing into one of said first and second sections;

a plurality of pockets, each of said pockets being attached to said first side of said second compartment; and a flap being attached to and being coextensive with said first side edge, said flap having a width less than at least one-half of a length of said first compartment.

2. An itinerary and identification holding device comprising:

a flexible pocketbook having a rectangular shape and being constructed of a non-transparent material, said pocketbook including a first compartment and a second compartment divided along a fold line extending between a top edge and a bottom edge of said pocketbook, said pocketbook having a first side edge abutting said first compartment and a second side edge abutting said second compartment, each of said first and second compartments having a first side and a second side, said first side of said first compartment having an elongated first slot therein, said first slot being positioned adjacent to said first side edge and extending into said first compartment, each of said first and second sides of said first compartment having a viewing window therein for viewing an interior of said first compartment and viewing through said first compartment, each of said viewing windows in said first compartments substantially exposing an entity of said first compartment, said viewing windows in said first compartment having approximately a same size as each other, said first slot being spaced from said window in said first side, said second side of said second compartment having an elongated second slot therein, said second slot extending between said second side edge and said fold line and forming an opening into said second compartment.

3. The device according to claim 2, wherein said bottom edge has a length generally between 6 inches and 9 inches and said first side edge having a height generally between 7 inches and 10 inches.

4. The device according to claim 3, wherein said second slot is positioned nearer said top edge and than said bottom edge.

5. The device according to claim 3, further including a dividing wall extending between said second side edge and said fold line such that a first portion and a second portion of said second compartment is defined, said second portion being positioned adjacent to said bottom edge, said dividing wall being positioned between said bottom edge and said second slot, a section wall extending between said dividing wall and said bottom edge and sectioning said second portion into a first section and a second section, said second side of said second compartment having a third slot therein extending into said first section, said second side of said second compartment having a fourth slot therein extending into said second section.

6. The device according to claim 5, wherein said second side of said second compartment has a pair of windows therein, each of said windows in said second compartment being positioned for viewing into one of said first and second sections.

7. The device according to claim 3, further including a plurality of pockets, each of said pockets being attached to said first side of said second compartment.

8. The device according to claim 3, further including a flap being attached to and being coextensive with said first side edge, said flap having a width less than at least one-half of a length of said first compartment.

* * * * *